US007238910B1

(12) United States Patent
Puskar et al.

(10) Patent No.: US 7,238,910 B1
(45) Date of Patent: Jul. 3, 2007

(54) CROSSBAR ASSIST MECHANISM AND ELECTRICAL SWITCHING APPARATUS EMPLOYING THE SAME

(75) Inventors: Michael P. Puskar, Carnegie Borough, PA (US); Robert W. Mueller, Green Township, PA (US); William E. Beatty, Beaver Brighton Township, PA (US); Kenneth D. Kolberg, McKees Rocks, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/434,006

(22) Filed: May 15, 2006

(51) Int. Cl.
*H01H 3/00* (2006.01)

(52) U.S. Cl. ..... 218/154; 218/153

(58) Field of Classification Search ..... 218/7, 218/14, 120, 140, 153–157, 78, 84, 92; 200/400–402; 335/6–16, 167–174
See application file for complete search history.

(56) References Cited

U.S. PATENT DOCUMENTS 5,898,146 A 4/1999 Beck et al.
5,910,760 A 6/1999 Malingowski et al.
5,927,484 A * 7/1999 Malingowski et al. ..... 200/401
6,204,465 B1 * 3/2001 Gula et al. ..... 218/154
6,236,294 B1 5/2001 Zindler et al.
6,262,645 B1 7/2001 McNeil et al.
6,281,459 B1 * 8/2001 Munsch et al. ..... 218/22
6,373,016 B2 * 4/2002 Brouillat et al. ..... 218/154

* cited by examiner

*Primary Examiner*—Elvin Enad
*Assistant Examiner*—M Fishman
(74) *Attorney, Agent, or Firm*—Martin J. Moran

(57) ABSTRACT

A crossbar assist mechanism is for a circuit breaker including a housing, a movable contact, a stationary contact, and an operating mechanism. The operating mechanism includes a crossbar, a carrier coupled to the crossbar, and a movable contact arm which is pivotably cooperable with the carrier. The movable contact is disposed on the movable contact arm. The crossbar moves the carrier and the movable contact arm, thereby moving the movable contact into and out of electrical contact with the stationary contact. The crossbar assist mechanism includes an electrically conductive member electrically interconnecting the carrier and the movable contact arm to a load terminal. A spring disposed between the crossbar and the electrically conductive member biases the crossbar from a first position corresponding to the movable contact and the stationary contact being separated, toward a second position corresponding to the movable contact being in electrical contact with the stationary contact.

22 Claims, 2 Drawing Sheets

CROSSBAR ASSIST MECHANISM AND ELECTRICAL SWITCHING APPARATUS EMPLOYING THE SAME

BACKGROUND OF THE INVENTION

1. Field of the Invention

The invention relates generally to electrical switching apparatus and, more particularly, to a crossbar assist mechanism for electrical switching apparatus, such as a circuit breaker. The invention also relates to electrical switching apparatus having a crossbar assist mechanism.

2. Background Information

Electrical switching apparatus, such as circuit breakers, provide protection for electrical systems from electrical fault conditions such as, for example, current overloads, short circuits, and other fault conditions. Typically, circuit breakers include a spring powered operating mechanism which opens electrical contacts to interrupt the current through the conductors of an electrical system in response to abnormal conditions.

The electrical contacts generally comprise one or more movable contacts and one or more corresponding stationary contacts. Each pair of separable contacts is electrically connected, in series, between corresponding line and load terminals which are typically positioned at opposite ends of the circuit breaker. More specifically, each movable contact is disposed at or about a first end of a corresponding movable contact arm, which is part of a movable contact assembly. The movable contact arm is pivotably coupled, at or about its second end, to a crossbar of the operating mechanism. A suitable shunt (e.g., without limitation, flexible conductor) electrically connects the movable contact assembly to a load conductor, for example, by way of a clinch joint. Typically, a clinch joint comprises two thicknesses of material (e.g., without limitation, metal) joined, for example, by extruding one piece into the other using a punch and die to form a swaged joint in such a way that the two pieces cannot be subsequently separated. The operating mechanism controls the movable contact arm to pivot the movable contact into and out of electrical contact with the corresponding stationary contact. The crossbar carries the movable contact arms for all of the poles of the circuit breaker, and allows for simultaneous opening and closing of the contacts in all of the poles.

Manual opening and closing of the contacts is accomplished by way of an operating handle coupled to the crossbar. Specifically, the operating handle, which is disposed on the outside of the circuit breaker housing, is manipulated from an OFF position to an ON position in order to close the contacts. The contacts can also be tripped automatically by a trip unit in response to abnormal conditions. The trip unit includes, for example, a pivotable trip bar which latches the operating mechanism. Upon detection of an overcurrent condition, the trip unit rotates the trip bar to unlatch the operating mechanism which, in turn, pivots the crossbar and opens the contacts of all of the poles. Typically, the handle position corresponding to the tripped position is between the ON and OFF positions.

Certain circumstances can make it difficult for a user to manually move the operating handle from the OFF position to the ON position. For example, electrical current flowing through the circuit breaker generates heat which can adversely affect certain components of the circuit breaker operating mechanism, for example, by making them swell or enlarge. Thus, when the circuit breaker is hot, friction among the operating mechanism components increases, making it difficult for a user to manually turn the circuit breaker from the OFF position to the ON position.

There is a need, therefore, for facilitating operation of the circuit breaker from the OFF position to the ON position.

There is, therefore, room for improvement in electrical switching apparatus, and in mechanisms for facilitating the operation of the electrical switching apparatus operating mechanism.

SUMMARY OF THE INVENTION

These needs and others are met by embodiments of the invention, which are directed to a crossbar assist mechanism for an electrical switching apparatus. Through use of a unique biasing element, the crossbar assist mechanism facilitates movement of the circuit breaker operating handle from the OFF position toward the ON position.

As one aspect of the invention, a crossbar assist mechanism is provided for an electrical switching apparatus. The electrical switching apparatus includes a housing, a first conductor, a second conductor, a stationary contact, a movable contact, and an operating mechanism. The stationary contact is electrically connected to the first conductor. The operating mechanism includes a crossbar, a carrier having a first end coupled to the crossbar and a second end, and a movable contact arm. The movable contact arm is pivotably cooperable with the second end of the carrier. The movable contact is disposed on the movable contact arm, and the crossbar is structured to move the carrier and the movable contact arm, thereby moving the movable contact disposed on the movable contact arm into and out of electrical contact with the stationary contact. The crossbar assist mechanism comprises: an electrically conductive member structured to electrically interconnect the movable contact arm of the operating mechanism of the electrical switching apparatus and the second conductor; and a biasing member structured to be disposed between the crossbar of the operating mechanism of the electrical switching apparatus and the electrically conductive member, and further structured to bias the crossbar of the operating mechanism from a first position corresponding to the movable contact and the stationary contact being separated, toward a second position corresponding to the movable contact being in electrical contact with the stationary contact.

The biasing member may comprise a spring, such as a conical spring, which includes a first end and a second end, wherein the first end of the spring is structured to bias the crossbar of the operating mechanism of the electrical switching apparatus, and the second end of the spring is coupled to the electrically conductive member. The electrically conductive member may include an aperture structured to receive and secure the second end of the spring. The spring may also be fastened to the electrically conductive member in order to maintain the position of the spring within the aperture of the electrically conductive member. The electrically conductive member may comprise a clinch joint including a cast member having a first end and a second end, wherein the carrier and the movable contact arm of the operating mechanism of the electrical switching apparatus are structured to be pivotably and electrically coupled at or about the first end of the cast member, and the second end of the cast member is electrically coupled to the load conductor. The cast member may further comprise a top, wherein the aperture of the cast member comprises an elongated slot in the top of the cast member, wherein the second end of the spring includes at least one coil, and wherein the at least one coil of the second end of the spring is disposed within the elongated slot of the cast member.

As another aspect of the invention, an electrical switching apparatus comprises: a housing; separable contacts housed by the housing, the separable contacts comprising at least one movable contact and at least one stationary contact; an operating mechanism comprising a crossbar, at least one carrier, and at least one movable contact arm, each of the at least one movable contact being disposed on a corresponding one of the at least one movable contact arm, the at least one carrier having a first end coupled to the crossbar and a second end pivotably cooperable with the corresponding one of the at least one movable contact arm, the operating mechanism moving the at least one carrier and the corresponding one of the corresponding one of the at least one movable contact arm, thereby moving the at least one movable contact disposed on the at least one movable contact arm into and out of electrical contact with a corresponding one of the at least one stationary contact; and at least one crossbar assist mechanism, each of the at least one crossbar assist mechanism comprising: an electrically conductive member, the electrically conductive member being electrically connected to the at least one carrier and the corresponding one of the at least one movable contact arm of the operating mechanism, and a biasing member disposed between the crossbar of the operating mechanism and the electrically conductive member, in order to bias the crossbar of the operating mechanism from a first position corresponding to the at least one movable contact and the corresponding one of the at least one stationary contact being separated, toward a second position corresponding to the at least one movable contact being in electrical contact with the corresponding one of the at least one stationary contact.

The electrical switching apparatus may be a circuit breaker having a plurality of poles, wherein each of the poles of the circuit breaker comprises a single carrier coupled at or about its first end to the crossbar of the operating mechanism, a single movable contact arm pivotably cooperable with the second end of the single carrier, a single movable contact disposed on the single movable contact arm, and a single corresponding stationary contact, and wherein the at least one crossbar assist mechanism comprises a separate crossbar assist mechanism for each of the poles of the circuit breaker.

The operating mechanism may further comprise an operating handle having a first end accessible from the exterior of the housing of the circuit breaker, and a second end coupled to the crossbar of the operating mechanism. The operating handle may be operable among an OFF position corresponding to the first position of the operating mechanism, and an ON position corresponding to the second position of the operating mechanism, wherein the crossbar assist mechanism facilitates movement of the operating handle from the OFF position toward the ON position.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
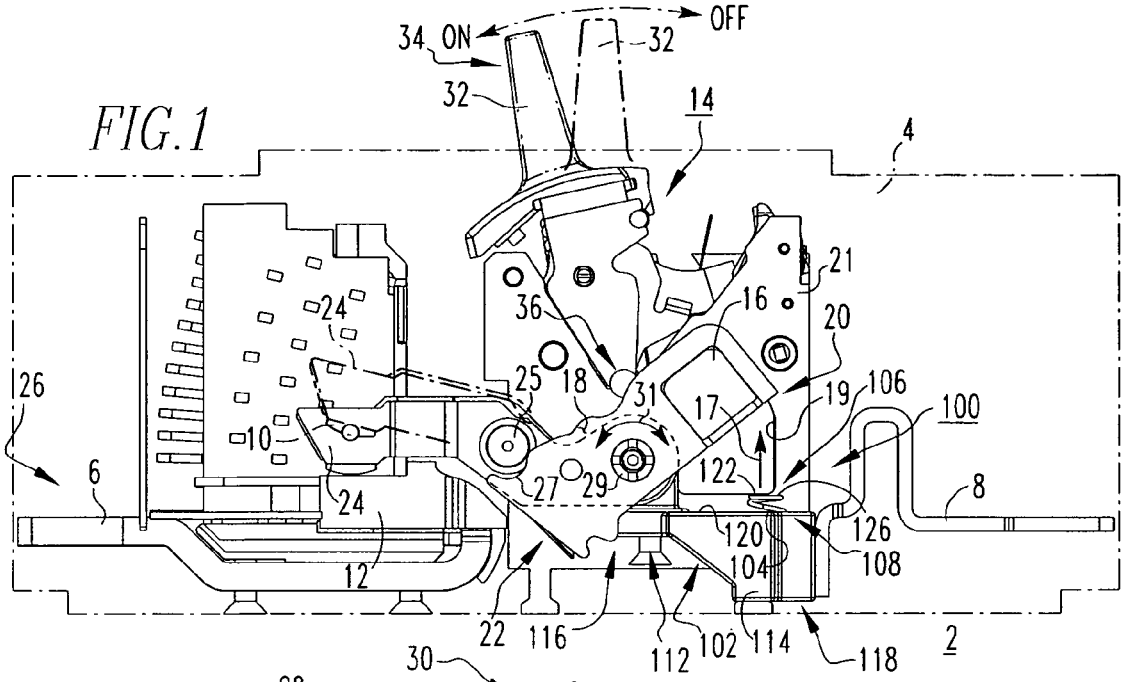
FIG. 1 is a side elevational view of a circuit breaker and crossbar assist mechanism in accordance with an embodiment of the invention, with the circuit breaker housing shown in simplified form, with a portion of one arc chute removed to show the separable contacts, and with the circuit breaker operating handle shown in the ON position.

For purposes of illustration, various embodiments of the invention will be shown and described as applied to the operating mechanism of a three-pole circuit breaker, although it will become apparent that they could also be applied to bias one or more components of the operating mechanism of any known or suitable electrical switching apparatus (e.g., without limitation, circuit switching devices and circuit interrupters such as circuit breakers, contactors, motor starters, motor controllers and other load controllers) having any number of poles.

Directional phrases used herein, such as, for example, left, right, clockwise, counterclockwise and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows a molded case circuit breaker 2 employing a crossbar assist mechanism 100. The circuit breaker 2 includes a housing 4 (shown in simplified form in phantom line drawing), a first conductor 6, a second conductor 8, separable contacts 10, 12 disposed between the first and second conductors 6, 8, and an operating mechanism 14.

Figure 2:
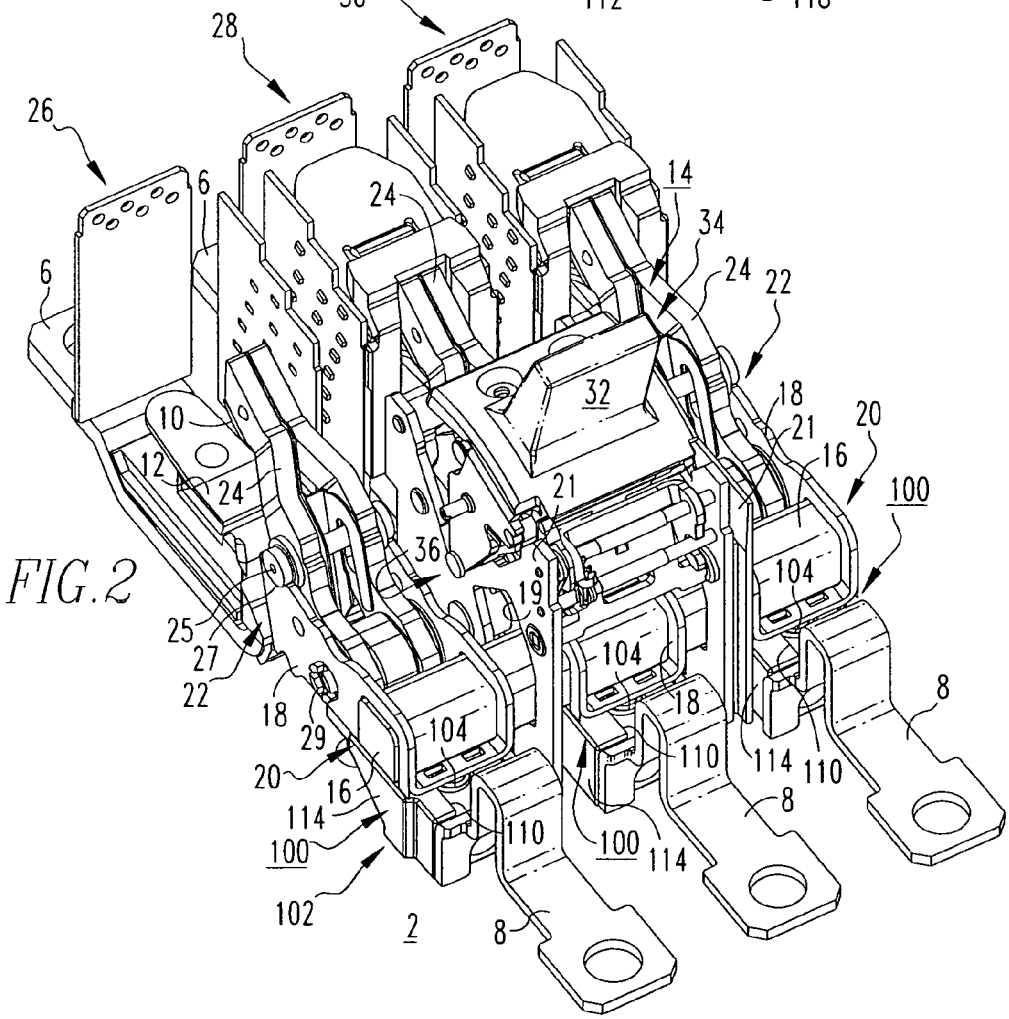
FIG. 2 is an isometric view of the molded case circuit breaker of FIG. 1 with the circuit breaker housing removed to show the three separate crossbar assist mechanisms for the three poles of the circuit breaker, and modified to show the circuit breaker operating handle in the OFF position.

As best shown in FIG. 2, the separable contacts comprise pairs of movable and stationary contacts 10, 12, which are electrically connected, in series, between the first conductor which, in the example shown, is a line conductor 6, and the second conductor which, in the example shown, is a load conductor 8. Thus, each of the stationary contacts 12 is electrically connected to a corresponding line conductor 6. In FIG. 2, the circuit breaker 2 is shown with the housing 4 (FIG. 1) removed to clearly show internal structures. Specifically, the circuit breaker 2 includes three poles 26, 28, 30, each having its own corresponding line conductor 6 (two line conductors 6 are shown), load conductor 8, and pair of separable contacts 10, 12 (as shown with pole 26). Each pole 26, 28, 30 further includes a separate crossbar assist mechanism 100. It will, however, be appreciated that the circuit breaker 2 could alternatively include any suitable number of poles, with any suitable number of crossbar assist mechanisms 100 wherein the number of crossbar assist mechanisms 100 could be the same as or different than the number of poles of the circuit breaker.

Referring to FIGS. 1 and 2, it will be appreciated that the operating mechanism 14 of the circuit breaker 2 includes a crossbar 16, at least one carrier 18, and at least one movable contact arm 24. As best shown in FIG. 2, the operating mechanism 14 of the example three-pole circuit breaker 2 includes three carriers 18, each having a corresponding movable contact arm 24. The movable contact 10 is disposed at or about one end of the movable contact arm 24, as shown. The carrier 18 has a first end 20 coupled to the crossbar 16, and a second end 22 which is pivotably cooperable with the movable contact arm 24. Specifically, the movable contact arm 24 includes a pivot pin 25 which is pivotable into and out of engagement with a corresponding cradle 27 proximate the first end 22 of carrier 18, when the carrier 18 moves. The carrier 18 pivots clockwise and counterclockwise about a pivot 29, as indicated by directional arrow 31 of FIG. 1. In the example of FIGS. 1 and 2, the crossbar 16 pivots with the carrier 18 within the confines of crossbar opening 19 of bracket 21 of the circuit breaker 2. Accordingly, the operating mechanism 14 moves the carriers 18 and the corresponding movable contact arms 24, thereby moving the movable contacts 10 disposed on the corresponding movable contact arms 24 into and out of electrical contact with the corresponding stationary contacts 12.

In FIG. 2, the operating mechanism 14 is shown in a first position corresponding to the movable contact 10 being separated from its corresponding stationary contact 12 for each pair of separable contacts 10, 12. In this position, the circuit breaker 2 is OFF. Conversely, FIG. 1 shows the movable and stationary contacts 10, 12 being in electrical contact with one another, corresponding to the second position of the operating mechanism 14, and the ON position of the circuit breaker 2. The operating mechanism 14 of the circuit breaker 2 further includes an operating handle 32 having a first end 34 which is accessible from the exterior of the housing 4 of the circuit breaker 2, and which is operable among an OFF position (FIG. 2), an ON position (FIG. 1), and also a tripped position (show in phantom line drawing in FIG. 1). The tripped position corresponds to the separable contacts 10, 12 (shown being tripped open in phantom line drawing in FIG. 1) in response to an electrical fault condition (e.g., without limitation, current overloads; short circuits; abnormal voltage conditions; other fault conditions). As shown, the tripped position of the example circuit breaker operating handle 32 is between the ON position of FIG. 1, and the OFF position of FIG. 2. It will, however, be appreciated that the tripped position of the operating handle 32 could alternatively be shared with the OFF position of the operating handle 32, without departing from the scope of the invention. The second end 36 of the operating handle 32 is coupled to the carrier 18 of the circuit breaker operating mechanism 14.

Figure 3:
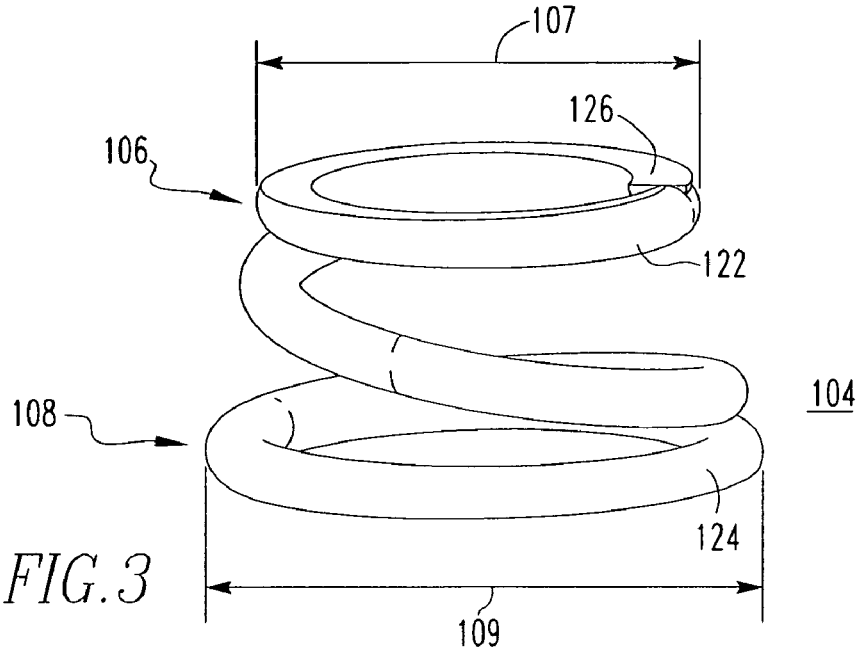
FIG. 3 is an isometric view of the biasing element for the crossbar assist mechanism of FIG. 1.
Figure 4:
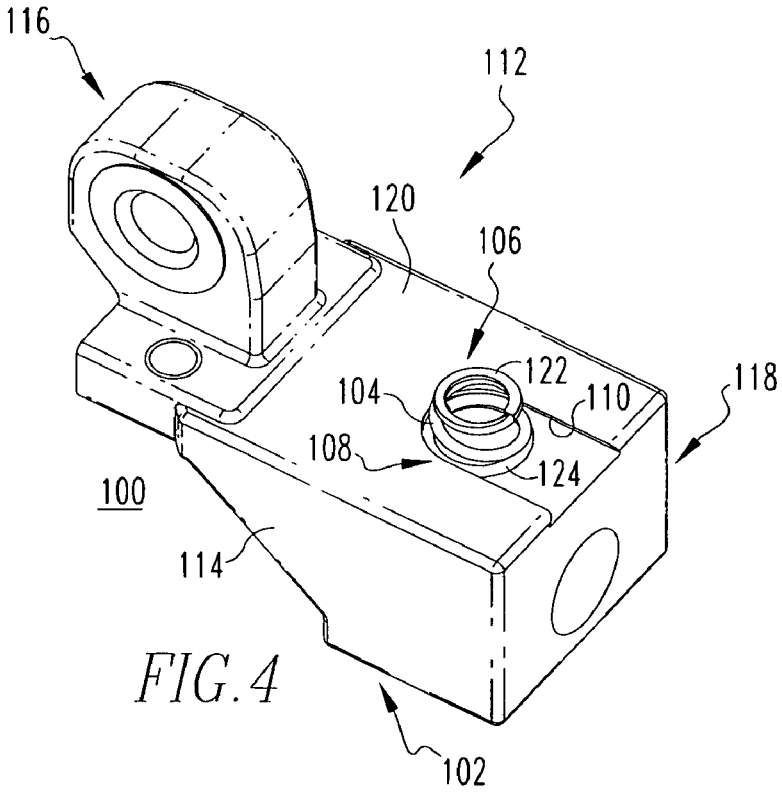
FIG. 4 is an isometric view of the crossbar assist mechanism of FIG. 1.

The crossbar assist mechanism 100, three of which are shown in the three-pole circuit breaker 2 of FIG. 2, facilitates movement of the operating handle 32 from the OFF position (FIG. 2) toward the ON position (FIG. 1). Specifically, each crossbar assist mechanism 100 includes an electrically conductive member 102 which is structured to electrically interconnect the movable contact arm 24 (partially shown in hidden line drawing in FIG. 1) of the circuit breaker operating mechanism 14 and the load conductor 8. A biasing member, such as the conical spring 104 shown, is disposed between the crossbar 16 of the circuit breaker operating mechanism 14 and the electrically conductive member 102. The conical spring 104 includes a first end 106 and a second end 108 (FIGS. 1, 3, and 4). The first end 106 of the conical spring 104 biases the crossbar 16 in the direction generally indicated by arrow 17 of FIG. 1, which shows the crossbar 16 after having already been engaged and biased by the conical spring 104. In other words, the conical spring 104 is compressed substantially flat when the crossbar 16 of the circuit breaker operating mechanism 14 is disposed in the first position (i.e., the circuit breaker operating handle 32 is in the OFF position) of FIG. 2. Then, in response to partial movement of the operating mechanism 14 such as, for example, manual manipulation of the circuit breaker operating handle 32 from the OFF position of FIG. 2 towards the ON position (corresponding to the second position of operating mechanism 14) of FIG. 1, the conical spring 104 provides a spring force to the crossbar 16 in order to facilitate continued motion of crossbar 16, carrier 18, movable contact arm 24, and the operating mechanism 14 generally, to the second or ON position (FIG. 1). It will, however, be appreciated that any known or suitable biasing member could be employed in any number and configuration other than, or in addition to the conical spring 104 which is shown and described. For example and without limitation, a leaf spring (not shown) or one or more Belleville washers (not shown) could be employed to provide the desired biasing force.

As shown in FIG. 3, the first end 106 of conical spring 104 has a first diameter 107, and the second end 108 of the conical spring 104 has a second diameter 109, wherein the first diameter 107 of the first end 106 is smaller than the second diameter 109 of second end 108. It is this structure which permits the conical spring 104 to compress substantially flat when the circuit breaker operating mechanism 14 is in the first position of FIG. 2, as previously discussed. The first end 106 of conical spring 104 further includes at least one coil 122. The coil 122 of the first end 106 has a substantially flat exterior surface 126, as shown. The substantially flat exterior surface 126 functions to provide substantially flush engagement with the crossbar 16 of the circuit breaker operating mechanism 14 when the operating mechanism 14 is in the first position of FIG. 2.

Continuing to refer to FIG. 3 and also to FIG. 4, it will be appreciated that the second end 108 of conical spring 104 also includes at least one coil 124. The coil 124 of the second end 108 of the conical spring 104 is coupled to the electrically conductive member 102 (FIG. 4). More specifically, the electrically conductive member 102 comprises a clinch joint 112 which, in the example of FIG. 4, includes a cast member 114. The cast member 114 includes a first end 116, and a second end 118. Referring back briefly to FIG. 1, it will be appreciated that the carrier 18 and movable contact arm 24 of the circuit breaker operating mechanism 14 are pivotable and are electrically coupled at or about the first end 116 of the cast member 114 by pivot 29. The second end 118 of the cast member 114 is electrically coupled to the load conductor 8.

As best shown in FIG. 4, the cast member 114 also includes a top 120 which includes an aperture, such as the elongated slot 110, shown. The second end 108 of the conical spring 104 and, in particular, the coil 124 of the second 108 is disposed within the elongated slot 110 of the cast member 114. More specifically, the coil 124 of the second end 108 of conical spring 104 slides into the elongated slot 110, which is preferably cast in the top 120 of the cast member 114. To maintain the position of the conical spring 104 within the elongated slot 110, the conical spring 104 is fastened to the cast member 114 using any known or suitable fastening mechanism or process. For example, and without limitation, the conical spring 104 in the example of FIG. 4, is staked (i.e., the edges of the elongated slot 110 are compressed or deformed (not expressly shown) over coil 124 of second end 108 of the spring 104) to secure it to the top 120 of cast member 114.

Accordingly, the crossbar assist mechanism 100 provides a novel and unique improvement for facilitating movement of the operating mechanism 14 of electrical switching apparatus 2. Specifically, the biasing element, such as the aforementioned conical spring 104, biases the crossbar 16 of the operating mechanism 14 thereby facilitating movement (i.e., toggle of the operating mechanism 14) from the first position to the second position. In this manner, the crossbar assist mechanism 100 facilitates user manipulation of the electrical switching apparatus operating handle 32 in order to overcome the disadvantages (e.g., without limitation, increased friction and associated difficulty of movement of the operating handle 32 in response to elevated temperatures of the electrical switching apparatus) of known prior art circuit breakers.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A crossbar assist mechanism for an electrical switching apparatus, said electrical switching apparatus including a housing, a first conductor, a second conductor, a movable contact, a stationary contact, and an operating mechanism, said stationary contact being electrically connected to said first conductor, said operating mechanism including a crossbar, a carrier having a first end coupled to said crossbar and a second end, and a movable contact arm, said movable contact arm being pivotably cooperable with the second end of said carrier, said movable contact being disposed on said movable contact arm, said crossbar being structured to move said carrier and said movable contact arm, thereby moving, said movable contact disposed on said movable contact arm into and out of electrical contact with said stationary contact, said crossbar assist mechanism comprising:

an electrically conductive member structured to electrically interconnect said movable contact arm of said operating mechanism of said electrical switching apparatus and said second conductor; and a biasing member structured to be disposed between said crossbar of said operating mechanism of said electrical switching apparatus and said electrically conductive member, and further structured to bias said crossbar of said operating mechanism from a first position corresponding to said movable contact and said stationary contact being separated, toward a second position corresponding to said movable contact being in electrical contact with said stationary contact.

2. The crossbar assist mechanism of claim 1 wherein said biasing member comprises a spring; wherein said spring includes a first end and a second end; wherein the first end of said spring is structured to bias said crossbar of said operating mechanism of said electrical switching apparatus; and wherein the second end of said spring is coupled to said electrically conductive member.

3. The crossbar assist mechanism of claim 2 wherein said electrically conductive member includes an aperture structured to receive and secure the second end of said spring.

4. The crossbar assist mechanism of claim 3 wherein said spring is fastened to said electrically conductive member in order to maintain the position of said spring within said aperture of said electrically conductive member.

5. The crossbar assist mechanism of claim 3 wherein said electrically conductive member comprises a clinch joint including a cast member; wherein said cast member comprises a first end and a second end; wherein said carrier and said movable contact arm of said operating mechanism of said electrical switching apparatus are structured to be pivotably and electrically coupled at or about the first end of said cast member; and wherein the second end of said cast member is electrically coupled to said load conductor.

6. The crossbar assist mechanism of claim 5 wherein said cast member further comprises a top; wherein said aperture of said cast member comprises an elongated slot in the top of said cast member; wherein the second end of said spring includes at least one coil; and wherein said at least one coil of the second end of said spring is disposed within said elongated slot of said cast member.

7. The crossbar assist mechanism of claim 2 wherein said spring comprises a conical spring; wherein the first end of said conical spring has a first diameter; wherein the second end of said conical spring has a second diameter; and wherein the first diameter of the first end of said conical spring is smaller than the second diameter of the second end of said conical spring.

8. The crossbar assist mechanism of claim 7 wherein said conical spring is structured to be compressed substantially flat when said crossbar of said operating mechanism of said electrical switching apparatus is disposed in said first position; and wherein in response to partial movement of said operating mechanism from said first position toward said second position, said conical spring is structured to provide a spring force to said crossbar in order to facilitate the movement of said operating mechanism toward said second position.

9. The crossbar assist mechanism of claim 7 wherein the first end of said conical spring includes at least one coil; and wherein said at least one coil of the first end of said conical spring includes a substantially flat exterior surface structured to provide flush engagement with said crossbar of said operating mechanism of said electrical switching apparatus.

10. The crossbar assist mechanism of claim 1 wherein said first conductor comprises a line conductor; and wherein said second conductor comprises a load conductor.

11. An electrical switching apparatus comprising:

a housing;

separable contacts housed by said housing, said separable contacts comprising at least one movable contact and at least one stationary contact;

an operating mechanism comprising a crossbar, at least one carrier, and at least one movable contact arm, each of said at least one movable contact being disposed on a corresponding one of said at least one movable contact arm, said at least one carrier having a first end coupled to said crossbar and a second end pivotably cooperating with said corresponding one of said at least one movable contact arm, said operating mechanism moving said at least one carrier and said corresponding one of said at least one movable contact arm, thereby moving said at least one movable contact disposed on said corresponding one of said at least one movable contact arm into and out of electrical contact with a corresponding one of said at least one stationary contact; and at least one crossbar assist mechanism, each of said at least one crossbar assist mechanism comprising:

an electrically conductive member, said electrically conductive member being electrically connected to said at least one carrier and said corresponding one of said at least one movable contact arm of said operating mechanism, and a biasing member disposed between said crossbar of said operating mechanism and said electrically conductive member, in order to bias said crossbar of said operating mechanism from a first position corresponding to said at least one movable contact and said corresponding one of said at least one stationary contact being separated, toward a second position corresponding to said at least one movable contact being in electrical contact with said corresponding one of said at least one stationary contact.

12. The electrical switching apparatus of claim 11 wherein said biasing member comprises a spring; wherein said spring includes a first end and a second end; wherein the first end of said spring biases said crossbar of said operating mechanism; and wherein the second end of said spring is coupled to said electrically conductive member.

13. The electrical switching apparatus of claim 12 wherein said electrically conductive member includes an aperture; and wherein said aperture receives and secures the second end of said spring.

14. The electrical switching apparatus of claim 13 wherein said spring is fastened to said electrically conductive member in order to maintain the position of said spring within said aperture of said electrically conductive member.

15. The electrical switching apparatus of claim 13 wherein said electrically conductive member comprises a cast member; wherein said cast member comprises a first end and a second end; and wherein said at least one carrier of said operating mechanism and said corresponding one of said at least one movable contact arm of said electrical switching apparatus are pivotably and electrically coupled at or about the first end of said cast member.

16. The electrical switching apparatus of claim 15 wherein said cast member further comprises a top; wherein said aperture of said cast member comprises an elongated slot in the top of said cast member; wherein the second end of said spring includes at least one coil; and wherein said at least one coil of the second end of said spring is disposed within said elongated slot of said cast member.

17. The electrical switching apparatus of claim 12 wherein said electrically conductive member comprises a cast member; wherein said cast member comprises a first end and a second end; wherein said at least one carrier of said operating mechanism and said corresponding one of said at least one movable contact arm of said electrical switching apparatus are pivotably and electrically coupled at or about the first end of said cast member; and wherein the second end of said spring is coupled to said cast member.

18. The electrical switching apparatus of claim 12 wherein said spring comprises a conical spring; wherein the first end of said conical spring has a first diameter; wherein the second end of said conical spring has a second diameter; and wherein the first diameter of the first end of said conical spring is smaller than the second diameter of the second end of said conical spring.

19. The electrical switching apparatus of claim 18 wherein said conical spring is compressed substantially flat when said crossbar of said operating mechanism of said electrical switching apparatus is disposed in said first position; and wherein in response to partial movement of said operating mechanism from said first position toward said second position, said conical spring provides a spring force to said crossbar in order to facilitate the movement of said operating mechanism toward said second position.

20. The electrical switching apparatus of claim 18 wherein the first end of said conical spring includes at least one coil; wherein said at least one coil of the first end of said conical spring includes a substantial flat exterior surface; and wherein said substantially flat exterior surface flushly engages said crossbar of said operating mechanism.

21. The electrical switching apparatus of claim 11 wherein said electrical switching apparatus is a circuit breaker having a plurality of poles; wherein each of said poles of said circuit breaker comprises a single carrier including a first end and a second end, said single carrier being coupled at or about the first end thereof to said crossbar of said operating mechanism, a single movable contact arm pivotably cooperable with the second end of said single carrier, a single movable contact disposed on said single movable contact arm, and a single corresponding stationary contact; and wherein said at least one crossbar assist mechanism comprises a separate crossbar assist mechanism for each of the poles of said circuit breaker.

22. The electrical switching apparatus of claim 21 wherein said operating mechanism further comprises an operating handle; wherein said operating handle includes a first end accessible from the exterior of said housing of said circuit breaker, and a second end coupled to said crossbar of said operating mechanism; wherein said operating handle is operable among an OFF position and an ON position; wherein said OFF position corresponds to said first position of said operating mechanism; wherein said ON position corresponds to said second position of said operating mechanism; and wherein said at least one crossbar assist mechanism facilitates movement of said operating handle from said OFF position toward said ON position.

* * * * *